US007043774B2

(12) United States Patent
Picchi

(10) Patent No.: US 7,043,774 B2
(45) Date of Patent: May 16, 2006

(54) FLUSH-TOILET BOWL INTEGRATED WITH A URINAL

(76) Inventor: Marcello Picchi, Via Palagetta 210/4 - 50013 Campi Bisenzio, Florence (IT)

( * ) Notice: Subject to any disclaimer, the term of this patent is extended or adjusted under 35 U.S.C. 154(b) by 233 days.

(21) Appl. No.: 10/488,624

(22) PCT Filed: Aug. 28, 2002

(86) PCT No.: PCT/IT02/00553

§ 371 (c)(1),
(2), (4) Date: Mar. 2, 2004

(87) PCT Pub. No.: WO03/021053

PCT Pub. Date: Mar. 13, 2003

(65) Prior Publication Data

US 2004/0231040 A1 Nov. 25, 2004

(30) Foreign Application Priority Data

Sep. 3, 2001 (IT) ..... FI2001A0165

(51) Int. Cl.
*E03D 11/02* (2006.01)

(52) U.S. Cl. ..... 4/420; 4/311; 4/420.4

(58) Field of Classification Search ..... 4/310, 4/311, 420, 421, 420.4, 420.5, 444–4, 47
See application file for complete search history.

(56) References Cited

U.S. PATENT DOCUMENTS

| | | | | |
|---|---|---|---|---|
| 210,786 | A * | 12/1878 | Knight | 4/420 |
| 2,075,830 | A * | 4/1937 | Salvoni | 4/445 X |
| 2,879,519 | A | 3/1959 | Mueller | 4/312 |
| 4,145,767 | A * | 3/1979 | Ibel | 4/420 X |

FOREIGN PATENT DOCUMENTS

| | | |
|---|---|---|
| DE | 1 255 055 | 11/1967 |
| DE | 196 25 658 | 1/1998 |

* cited by examiner

*Primary Examiner*—Robert M. Fetsuga
(74) *Attorney, Agent, or Firm*—McGlew & Tuttle, P.C.

(57) ABSTRACT

A bowl is provided having a back (3) presenting to the user the surface of a urinal (3A) designed to convey into the bowl the urine that is projected against it. There are likewise provided: an annular seat (6); a mobile front-covering panel (9) for covering the surface (3A); and a device for positioning the front-covering panel (9) and the seat (6), to enable their positioning according to a first configuration, with the panel (9) forming a backrest and covering of the surface (3A) and the seat (6) resting on the base (1) of the bowl, or else in a second configuration, with the panel (9) and the seat (6) set away at the front from the bowl and from the surface.

14 Claims, 6 Drawing Sheets

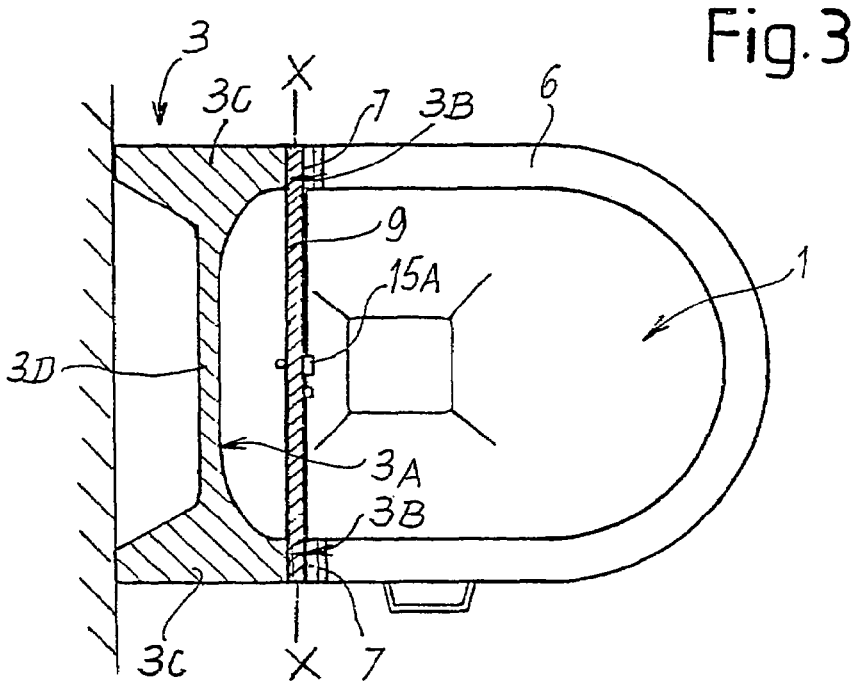
Fig.3
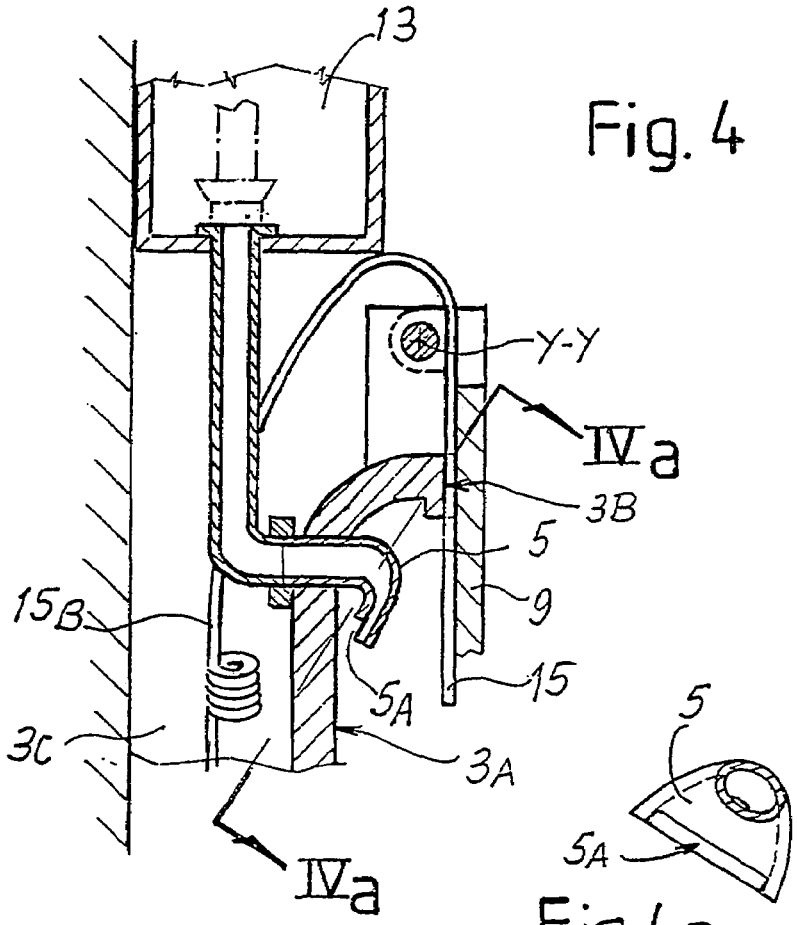
Fig. 4
Fig.4a

FLUSH-TOILET BOWL INTEGRATED WITH A URINAL

CROSS REFERENCE TO RELATED APPLICATIONS

This application is a U.S. National Phase application of International Application PCT/PCT/IT02/00553 filed Aug. 28, 2002 and claims the benefit of priority under 35 U.S.C. § 119 of Italian Application FI2001A000165 filed Sep. 3, 2001.

FIELD AND BACKGROUND OF THE INVENTION

The present invention relates to a flush-toilet bowl comprising a base for an annular seat and possibly a lid of the seat, both of which are mobile.

SUMMARY OF THE INVENTION

According to the invention, at the rear part of the bowl there is provided an approximately vertical back which develops above the plane of the seat, the back presenting to the user of the bowl a surface of a urinal designed for conveying into the bowl urine projected against it. An outflow terminal for outflow of water for washing the surface as well as the bowl is applied in the top part of the surface. In addition, there is provided a mobile panel for covering the front of the surface facing the user, as well as means for positioning the mobile panel and the seat with respect to the bowl. The means enable setting the panel and the seat either in a first configuration designed to form, respectively, a backrest and a sitting surface of the seat for use of the toilet bowl by the user in a sitting position. In this case the panel covering the urinal surface at the front, or else in a second configuration, with the panel and the seat at the front set away from the surface and from the base of the bowl, for use of the bowl with the user standing up.

In this way, the bowl according to the invention can be used both as a urinal to be used with the user in a standing position, and as a normal toilet bowl, without there being any risk, when it is used with the user in a seated position, of the user coming into contact with the vertical surface of the urinal.

The back preferably comprises a side and top projecting rim, within which the surface facing the user is set in, and the front-covering panel, in the configuration in which it forms a backrest, mates up with the side and top rim.

Advantageously, in a position corresponding to the side and top rims, the back presents an ample side and top ribbing which surrounds the relatively thin wall facing the bowl so as to form a urinal. The conformation facilitates construction of the back out of a single piece of porcelain.

In a first embodiment of the invention, the means for positioning the front-covering panel comprise a hinge for supporting the panel, the hinge being applied in the top part of the back, and a hinge for connection of the panel to the annular seat. In this way, when the device is used as a urinal, the seat is raised and upturned above the back—and hence above the surface of the urinal—along with the front-covering panel, so preventing the possibility of the seat and/or the panel getting splashed.

In a second embodiment of the invention, the positioning means comprise a side hinge between the annular seat and the bowl and another hinge between the rear part of the seat and the front-covering panel. In this way the seat can be set away to one side of the bowl, and, along with it, the covering panel of the surface of the urinal.

In another embodiment of the invention, the positioning means comprise a side hinge between the front-covering panel for covering the surface of the urinal and the bowl, and another hinge between the rear part of the seat and the front-covering panel. In this way, the covering panel for covering the surface of the urinal can be set away to the side of the back, and, along with it, the seat.

In all the embodiments cited, articulated to the hinge, between the seat and the front-covering panel, there an also be provided a normal lid of the seat.

The outflow terminal applied in the top part of the surface of the urinal is in direct communication with the discharge pipe of a flushing cistern for flushing the bowl, and has a passage of water, which converges in a vertical plane and diverges in a plane orthogonal to the vertical plane, with the outflow mouth facing the surface of the urinal, thus creating a blade-like jet of water, which diverges at the sides, designed to wash practically the entire surface of the urinal and the internal surface of the bowl.

In addition, the front-covering panel, in the backrest configuration, may have, in the middle and in the proximity of the hinge with the seat, a second relatively small outflow mouth in communication with the water mains supply, designed to project, in a controlled way—by means of a tap purposely provided and set within convenient reach of the user, a jet of water for washing oriented in the direction of the anus of the user, who is in a sitting position. The jet is supplied through a pipe provided with at least one flexible tubular stretch, for enabling the rotational movements of the front-covering panel itself.

A flushing cistern for washing the bowl may be installed above the back, or else may form an integral part of the back, in which case there is provided a separate supply of water for washing for the outflow terminal applied to the surface of the urinal.

The bowl may also comprise a shower-head handpiece hanging at the side of the flushing cistern or hanging from the back, for a further washing of the bowl and/or for personal washing of the user.

The back may be integral with the base of the bowl itself, and the bowl may be of the type resting on the ground or else be applied to the wall.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 3 is a top-plan view according to the line III—III of FIG. 2;

FIG. 4 illustrates the detail IV of FIG. 2, enlarged;

FIG. 4*a* is a cross-sectional view according to the line IVa—IVa of FIG. 4;

DESCRIPTION OF THE PREFERRED EMBODIMENTS

Figure 1:
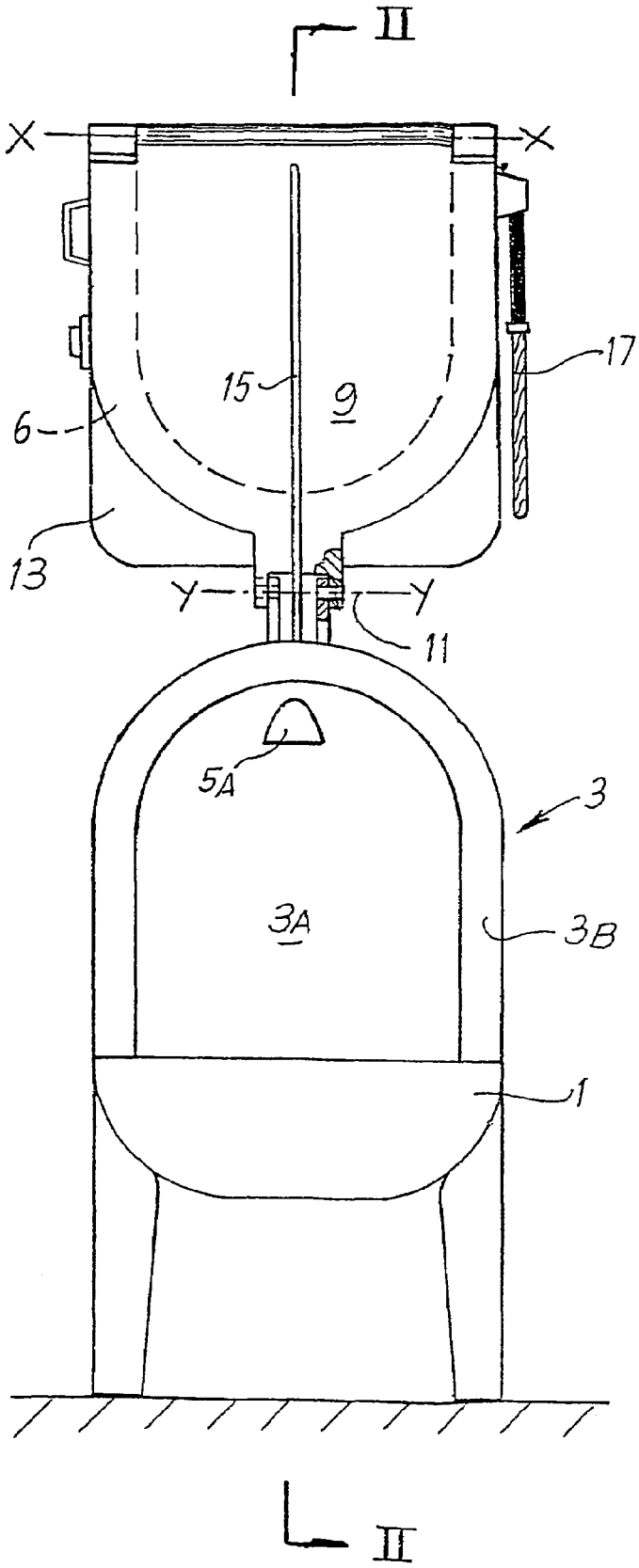
FIG. 1 is a front view of a bowl according to the invention in the configuration where it is used as a urinal, according to a first embodiment of the invention.

Referring to the drawings in particular, a bowl is formed by a seat-like base 1 (FIGS. 1 and 2) similar to a conventional flush toilet bowl, and by a vertical back 3 integral with the base 1. For example, the base-back ensemble may be obtained out of a single porcelain casting. The back 3 comprises a wall 3D (FIG. 3) with a front surface 3A of the urinal set in within a rim 38 projecting at the front from an extensive reinforcement or ribbing 3C that surrounds it at the sides and at the top. Applied to the top part of the surface 3A is an outflow terminal 5 of a pipe for discharge of water, which has an outflow section 5A oriented so that the water coming out will lap practically the entire underlying surface 3A in a uniform manner, for washing of the latter. For this purpose, the terminal 5 has a curve (FIG. 4) of approximately 120" and the channel formed thereby has, in cross section (with reference to FIG. 4 and FIG. 4*a*), a pattern converging in the plane of the drawing and a pattern diverging in the plane orthogonal to that of the drawing. At the bottom, the surface of the urinal 3A is radiused to the internal surface of the base 1 of the bowl, so that urine and washing water are conveyed into the base 1 and discharged normally through the U-bend trap 1 A.

As is customary, resting on the top rim of the base 1 is an annular seat 6 (FIG. 2), which is hinged, by means of a hinge 7 with horizontal axis X—X to a front-covering panel 9 for covering the surface of the urinal 3A; a block 68 withholds the seat 6 from sliding forwards. The panel 9 is in turn hinged, by means of a hinge 11 with horizontal axis Y—Y, to the top part of the back 3 and—in the configuration of FIG. 2—is resting against the rim 3B of the back 3, covering completely the surface of the urinal 3A and for a backrest for the seat.

A flushing cistern 13 is set on top of the back and supplies the outflow terminal 5.

Figure 2:
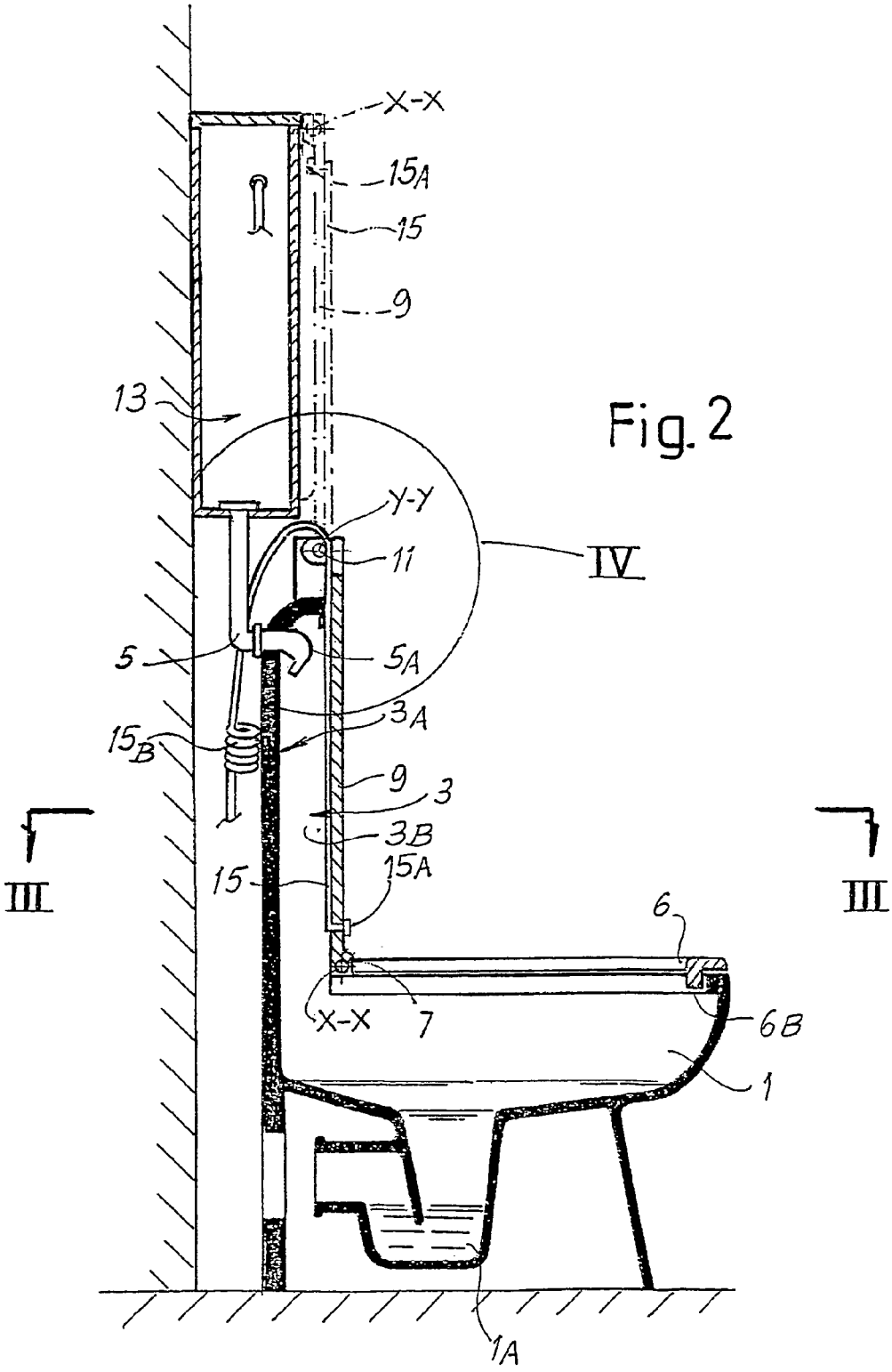
FIG. 2 is a side view of the bowl sectioned according to the line II—II of FIG. 1, in the configuration of use by the user in the seated position.
Figure 5:
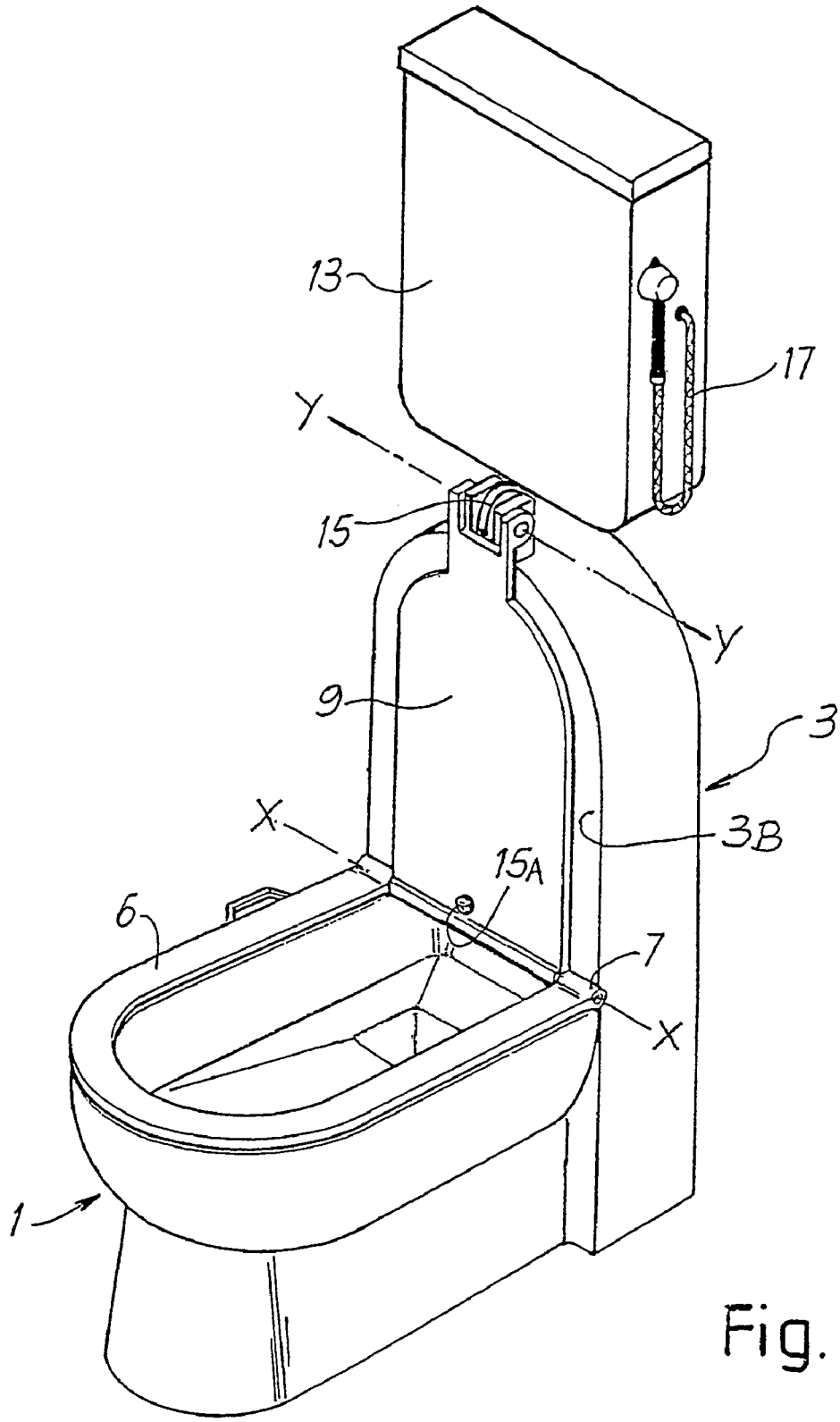
FIG. 5 is a perspective view of the bowl of FIG. 1.

In this way, the bowl may be used either by the user in a standing position as a urinal in the configuration of FIG. 1, with the panel 9 and the seat 6 both raised above the back 3, or else by the user in a seated position—in the configuration of FIG. 2 without any risk of the user coming into contact with any surfaces that might possibly have been dirtied when the device has previously been used as a urinal. Along the median part of the panel 9, orthogonal to the axis X—X of the hinge 7, there runs a tube 15 for carrying water for washing to an outflow jet 15A, for personal washing (i.e., as a bidet). The tube 15 is connected to the water mains supply by means of a flexible stretch 158 and a shutoff tap set within convenient reach of the user when the latter is in a sitting position (not illustrated in the drawings). The embodiment of FIG. 1 also includes a shower head handpiece 17 set hanging at the side of the flushing cistern 13 or from the back 3, for a further washing of the bowl and/or for personal washing of the user.

Figure 6:
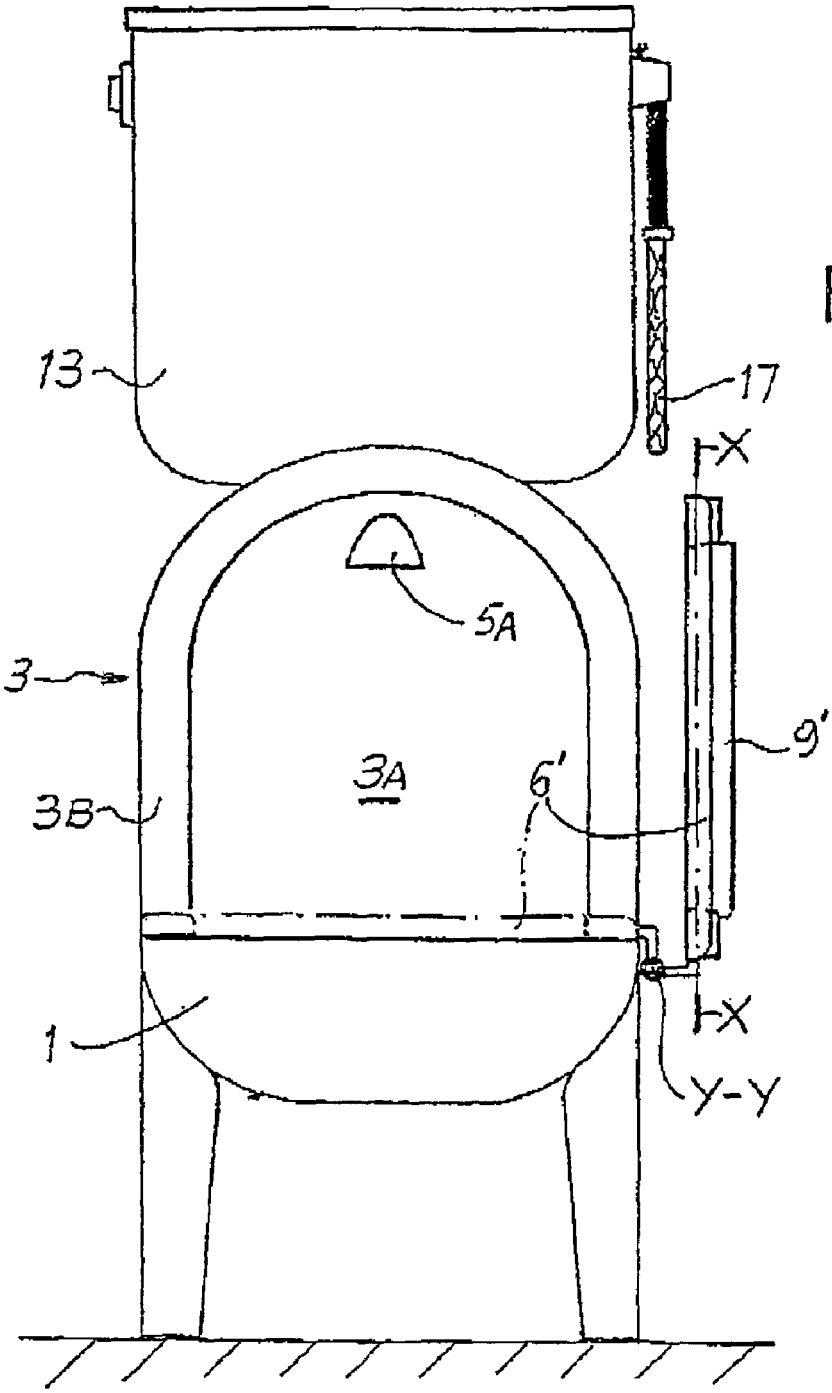
FIG. 6 is a front view of another embodiment of the invention.

In the embodiment illustrated in FIG. 6, the annular seat 6', unlike in the case described above, is hinged directly to the bowl 1 by means of a side hinge of axis Y1—Y1, whilst the mobile covering panel 9' for covering the surface of the urinal 3A is hinged to the seat 6' according to an axis X—X, in the same way as for the previous case. The other elements of the bowl with urinal are similar to the corresponding ones of the previous case and are designated by the same reference numbers. Consequently, in the embodiment of FIG. 6, the seat 6' and the panel 9' can be set away at the side, as illustrated again in FIG. 6, to enable use of the device as a urinal by the user in a standing position. The embodiment of FIG. 6 also includes a shower head handpiece 17 set hanging at the side of the flushing cistern 13 or from the back 3, for a further washing of the bowl and/or for personal washing of the user.

Figure 7:
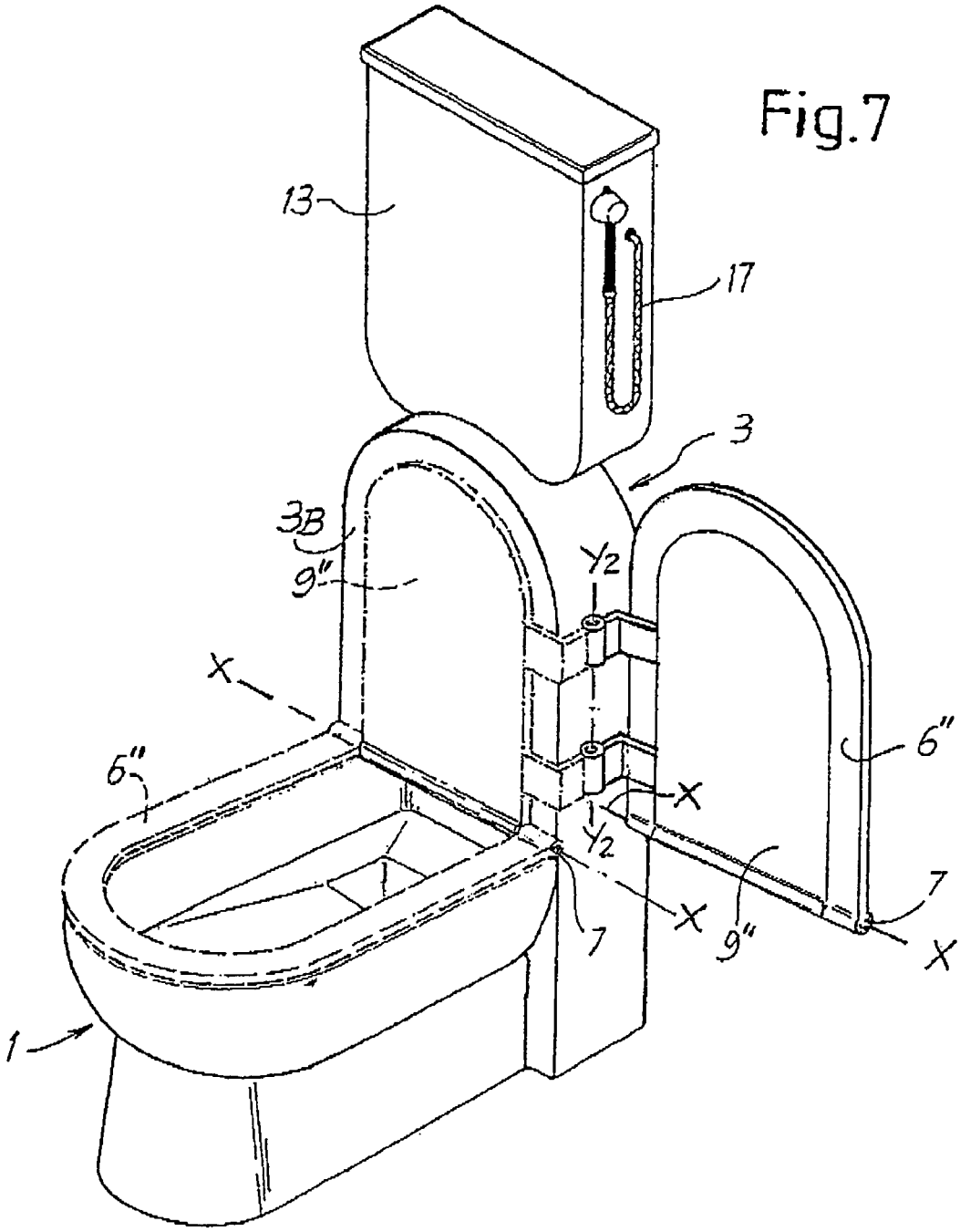
FIG. 7 is a perspective view of a further embodiment of the invention.

In the embodiment illustrated in FIG. 7, the covering panel 9" for covering the surface of the urinal, unlike in the case of FIG. 1, is hinged directly to the back 3 by means of a side hinge of axis Y2—Y2, whilst the seat 6" is hinged to the panel 9" according to an axis X—X, in the same way as in the cases of FIGS. 1 and 6. The other elements of the bowl with urinal are similar to the corresponding ones of the case illustrated in FIG. 1 and are designated by the same reference numbers. Consequently, in the embodiment of FIG. 7 the panel 9" and the seat 6" can be set away to one side, as illustrated once again in FIG. 7, to enable use of the device as a urinal by the user in a standing position. The embodiment of FIG. 7 also includes a shower head handpiece 17.

It is of course understood that the drawing merely provides, by way of example, a practical demonstration of the invention, it being possible for the latter to undergo variations in its embodiments and arrangements, without—thereby departing from the sphere of the underlying idea. The possible presence of reference numbers in the annexed claims has purely the purpose of facilitating reading thereof with reference to the description, and in no way limits the scope of protection represented by the claims.

While specific embodiments of the invention have been shown and described in detail to illustrate the application of the principles of the invention, it will be understood that the invention may be embodied otherwise without departing from such principles.

The invention claimed is:

1. A flush-toilet bowl comprising:

a base;

a seat movable relative to said base;

a back at a rear portion of the bowl, set approximately vertical and developing above the sitting surface, said back presenting to a user of the bowl a surface of a urinal designed to convey into the bowl urine projected against said back;

an outflow terminal of water at a top portion of said surface, said outflow terminal for washing said surface as well as the bowl;

a mobile front-covering panel for covering said surface facing the user; and a positioning means for positioning said mobile panel and said seat with respect to the bowl, said positioning means enabling setting of said panel and said seat either in a first configuration designed to form, respectively, a backrest and sitting surface of said seat, for use of the bowl with the user in a sitting position, said panel covering at the front of said surface, or else in a second configuration with said panel and said seat at the front set away from the surface and from the base of the bowl, for use of the bowl with the user in a standing position.

2. The bowl according to claim 1, further comprising an outflow mouth, in addition to said outflow terminal, said outflow mouth being provided in the base of the bowl there for washing of the bowl.

3. The bowl according to claim 1, wherein said back comprises a side and top rim projecting at the front, in which said surface is set in, said surface being the front face of a wall, from which said top rim juts out, and said front-covering panel, in the configuration forming a backrest, mates up with said side and said top rim.

4. The bowl according to claim 1, wherein said positioning means for positioning said front-covering panel comprises a hinge with axis—for supporting the panel—applied to the top part of said back, and a hinge with axis—for connection of said panel to said seat.

5. The bowl according to claim 4, wherein articulated to hinge of axis, between said seat and said panel, there is also a normal lid of the seat.

6. The bowl according to claim 1, wherein said positioning means comprise a side hinge with axis between the seat and the bowl, and another hinge with axis set between the rear part of the seat and said front-covering panel.

7. The bowl according to claim 1, wherein said positioning means comprise a side hinge with axis set between the front-covering panel of the surface of the urinal and the back, and another hinge with axis set between a rear part of the seat and said panel.

8. The bowl according to claim 1, wherein said panel, in the configuration of backrest, has, in a middle and in a proximity of a hinge with said seat, an outflow jet designed to project water for washing in the direction of an anus of the user who is sitting on said seat, said jet being supplied by means of a pipe provided with at least one flexible tubular stretch, for enabling the rotational movements of the front-covering panel itself, and with a tap set within convenient reach of the seated user.

9. The bowl according to claim 1, further comprising a flushing cistern for washing the bowl, said cistern being set on top of said back.

10. The bowl according to claim 1, wherein said back is connected to a flushing cistern for cleaning the bowl, said cistern resting on the rear part of said bowl, there being provided a separate supply for said outflow terminal for washing the surface of the urinal.

11. The bowl according to claim 1, wherein it comprises a shower head handpiece set hanging at the side of the flushing cistern or from the back, for a further washing of the bowl and/or for personal washing of the user.

12. The bowl according to claim 1, wherein said back is integral with the base of the bowl itself.

13. The bowl according to claim 1, wherein said back has an extensive side and top ribbing or reinforcement with a rim facing frontwards, the ribbing thus surrounding said wall, which has a relatively small thickness.

14. The bow according to claim 1, wherein said outflow terminal, which is facing the surface of the urinal, has the channel for passage of water according to a pattern converging in the vertical plane orthogonal to said surface and a pattern diverging in a plane orthogonal to said vertical plane.

* * * * *